US008356799B2

(12) United States Patent
Cheslock

(10) Patent No.: US 8,356,799 B2
(45) Date of Patent: Jan. 22, 2013

(54) STAKE REMOVAL DEVICE

(76) Inventor: Steven Thomas Cheslock, Medina, OH (US)

( * ) Notice: Subject to any disclaimer, the term of this patent is extended or adjusted under 35 U.S.C. 154(b) by 37 days.

(21) Appl. No.: 12/898,308

(22) Filed: Oct. 5, 2010

(65) Prior Publication Data

US 2011/0079758 A1 Apr. 7, 2011

Related U.S. Application Data

(60) Provisional application No. 61/248,897, filed on Oct. 6, 2009.

(51) Int. Cl.
*B66F 3/00* (2006.01)
*B21F 9/00* (2006.01)

(52) U.S. Cl. ..... 254/261; 254/243; 254/262

(58) Field of Classification Search ..... 254/243, 254/261, 262
See application file for complete search history.

(56) References Cited

U.S. PATENT DOCUMENTS 3,211,240 A 10/1965 Smitter et al.
3,757,893 A * 9/1973 Hobbs ..... 182/6
4,401,246 A * 8/1983 Dickinson et al. ..... 224/150
5,311,967 A * 5/1994 Kennedy ..... 182/133
5,488,798 A * 2/1996 Beachel ..... 43/21.2
5,996,871 A * 12/1999 Maeng ..... 224/645
6,193,012 B1 * 2/2001 Olivas ..... 182/129
6,279,795 B1 * 8/2001 Pierzina ..... 224/150
6,371,346 B1 * 4/2002 Sharma ..... 224/578
D457,725 S * 5/2002 Parsons ..... D3/327
6,550,653 B2 * 4/2003 Matthews ..... 224/250
6,647,656 B2 * 11/2003 Mazzagetti ..... 42/85
6,672,494 B1 * 1/2004 Fernandez ..... 224/576
6,712,251 B2 * 3/2004 Godshaw et al. ..... 224/675
6,767,290 B1 * 7/2004 Tan ..... 473/212
6,863,202 B2 * 3/2005 Ammerman ..... 224/607
7,051,836 B2 * 5/2006 Green ..... 182/7
7,082,954 B1 8/2006 Flanery et al.
7,121,049 B2 10/2006 Cohen et al.
7,318,542 B2 * 1/2008 Godshaw et al. ..... 224/674
7,533,430 B2 * 5/2009 Moxey ..... 7/143
7,832,802 B2 * 11/2010 Ehlers et al. ..... 297/393
7,909,215 B2 * 3/2011 McGuire et al. ..... 224/627
8,042,195 B1 * 10/2011 Massey ..... 2/69.5

* cited by examiner

*Primary Examiner* — Emmanuel M Marcelo
(74) *Attorney, Agent, or Firm* — Fay Sharpe LLP

(57) ABSTRACT

A stake removal device is provided. The device includes a proximal end for engaging a stake and distal end for engaging the user's hand. The device further includes an elongated intermediate portion in connection with the proximal and distal ends.

14 Claims, 2 Drawing Sheets

STAKE REMOVAL DEVICE

This application claims the priority benefit of U.S. application Ser. No. 61/248,897, filed Oct. 6, 2009, the disclosure of which is incorporated herein by reference.

BACKGROUND

The present disclosure relates to a stake removal tool, more specifically to a tool for removing in-ground stakes. The stake removal tool finds particular application in commercial and recreational stake removal, although it will be appreciated that selected aspects may find use in related applications encountering the same issues of a stake removal tool capable of removing a stake from the ground completely and easily.

By way of example, the tool is described herein for use in removing a stake for securing a structure to the ground, though use of the tool is not limited to removing tent stakes. A stake is a spike of varying design typically constructed from wood, metal, plastic, or a composite material. The stake is driven into the ground between a 45 and 90 degree angle around the perimeter of an individual or family camping tents, commercial rental/party/wedding tents, shade tents/canopies/sun shelters, etc. They can even be staked in a hard surface by driving the stake into a securing feature. In general, tents feature a double stitched nylon stake loop at each tent corner and midway points on each tent middle. The stake loops are attached to the heads of the stakes with the tent stake positioned so that the stake loop is pulled tight. This keeps the bottom of the tent flat, prevents damage and keeps the tent from shifting position. Stakes typically are notched, having a head portion with a diameter or width greater than that of the portion that is put into the ground. The notch or head is used to prevent the loop from slipping off the stake when in use.

Because the stakes are secured into the ground, and may be at an angle, it is often difficult to gain the leverage necessary to remove a stake securely placed in the ground upon dismantling of the tent. In fact, depending on how hard the ground is, several problems may occur during attempts to remove the tent stakes. For example, if another tool is used the stake may be bent. In addition, a person attempting to remove a stake may cause injury to his back.

Even in light of recent advances, the industry continues to lack a low cost stake removal device useful in the recreational and commercial industries and capable of removing stakes quickly, efficiently, and easily with stakes of conventional construction.

BRIEF DESCRIPTION

In an exemplary embodiment, a stake removal device includes a proximal end for engaging a stake and a distal end for engaging the user's hand. The stake removal device further includes an elongated intermediate portion in connection with the proximal and distal ends.

In another exemplary embodiment, a method for removal of a stake using a stake removal device includes providing a device comprising at least a proximal end for engaging a stake and a distal end for engaging a user's hand. The method further includes providing an elongated intermediate portion in connection with the proximal and distal ends and a padding material surrounding at least a portion of the elongated intermediate portion.

In yet another exemplary embodiment, a stake removal device includes a proximal end for engaging a stake and a distal end for engaging a user's hand. The distal end includes a strap adjustable buckle. The proximal and distal ends have the shape of a flexible loop. The stake removal device further includes an elongated intermediate portion in connection with the proximal and distal ends and a padding material surrounding at least a portion of the elongated intermediate portion.

In one embodiment of the invention, the proximal and distal ends have the shape of a flexible loop.

Another benefit realized by the stake removal device is the ability to pull a stake from the ground at various angles.

A primary benefit realized by the stake removal device is a low cost device to be sold in the recreational market.

Another benefit realized by the stake removal device is the ability to efficiently and inexpensively manufacture the device.

Another benefit realized by the stake removal device is the ability to remove stakes quickly and efficiently.

Another benefit realized by the stake removal device is the utility of the device with stakes of conventional construction.

Still other features and benefits of the stake removal device according to the invention will become more apparent from reading and understanding the following detailed description.

DETAILED DESCRIPTION

Unexpectedly, the current inventive stake removal device is a cost effective, flexible loop system with the ability to remove driven stakes from various earthen materials, such as dirt, sand, or gravel at any angle. The unique flexible loop design allows for use of the tool to remove stakes protruding from the ground at any angle, i.e. 90°, 45°, etc. Further, due to the use of an adjustable-length intermediate portion, the user may be at any distance from the stake that is comfortable for that user and yet efficiently removes the stake.

The stake to be removed, such as, for example, a tent stake, is a spike, generally with a hook or hole at the top end. It is typically made from wood, metal, plastic, or composite material. The tent stake is pushed or driven into the ground to secure a tent to the surface of the ground, either directly by attaching to the tent's material, or by connecting to ropes attached to the tent.

Higher quality tent stakes may have symmetrical shaped ends, conical or "V" shaped, to ensure that the stake can be driven into the ground without veering off alignment. The tent stakes will also typically have hook extensions to allow the end of the hook to also be driven into the ground, providing a second ground contact point, to reduce the risk that the stake may turn in the ground under tension and allow the rope it is holding to slip off the hook.

Figure 1:
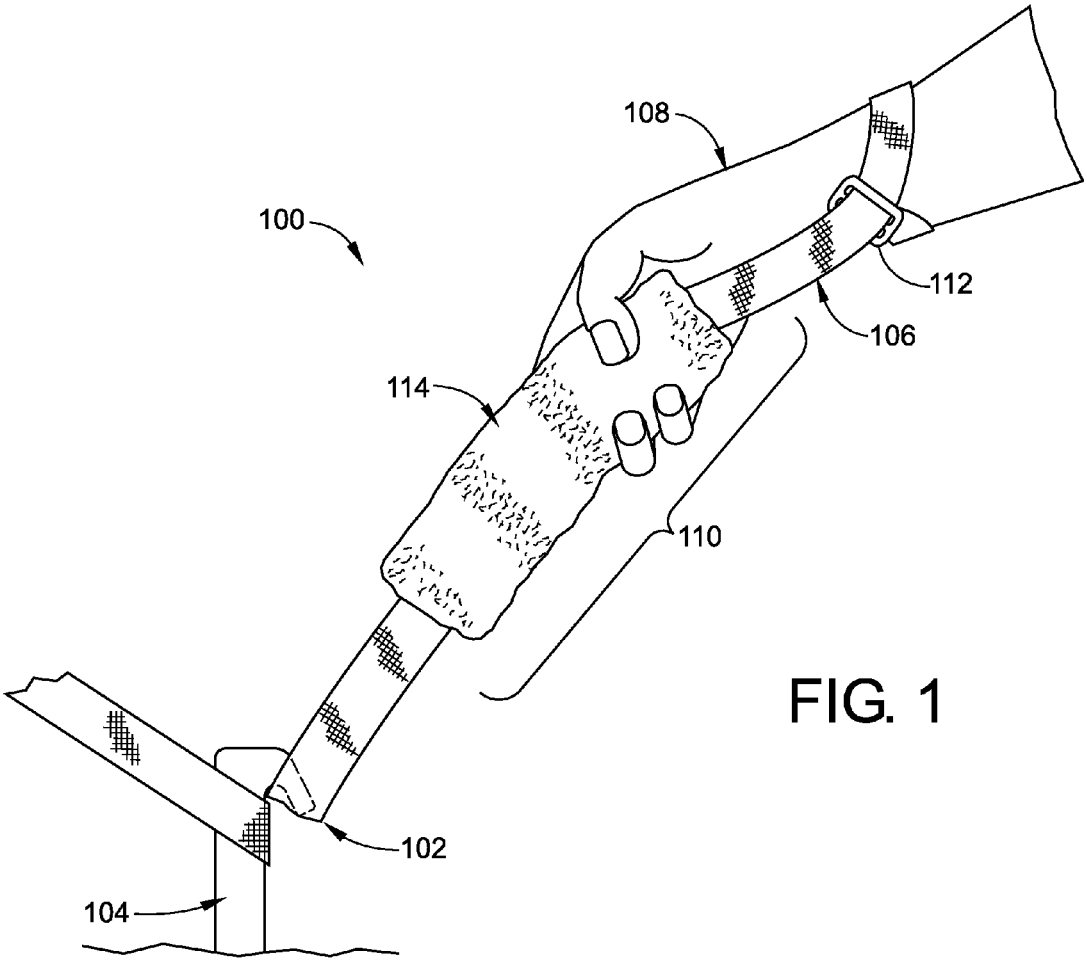
FIG. 1 is a perspective view of a stake removal device according to an exemplary embodiment.
Figure 2:
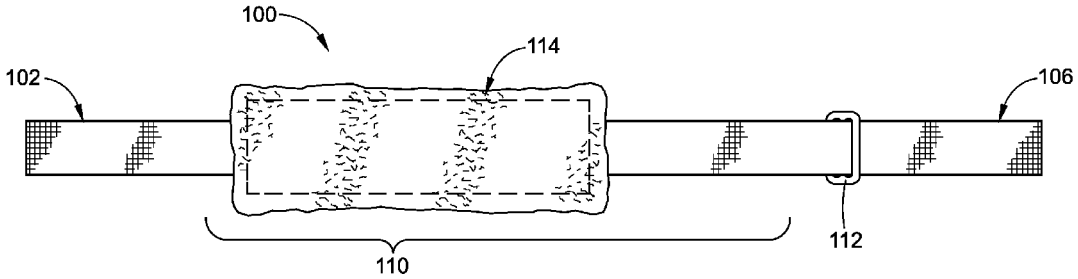
FIG. 2 is a top view of a stake removal device according to an exemplary embodiment.
Figure 3:
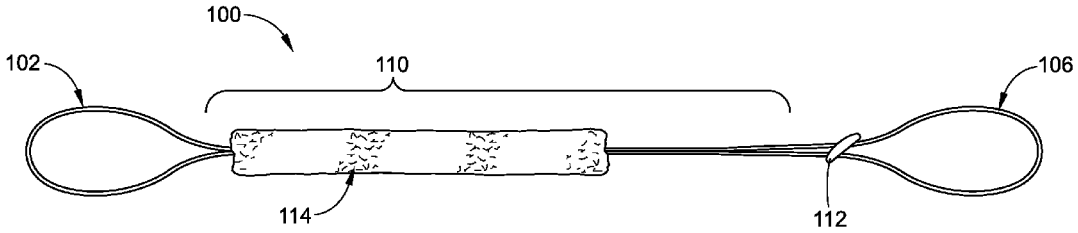
FIG. 3 is a side view of a stake removal device according to an exemplary embodiment.

Various views of an exemplary stake removal device 100 are illustrated in FIGS. 1-3. The stake removal device includes a proximal end 102 for engaging a stake 104 (shown in FIG. 1) and a distal end 106 for engaging a user's hand 108 (shown in FIG. 1). The proximal and distal ends 102, 106 are connected to each other by an intermediate portion 110. The distal end 106 may further include a strap adjuster buckle 112. A buckle is just one way to do this.

The stake removal tool is a device by which the user can remove driven stakes from various earthen materials, such as dirt, sand, or gravel. The device consists of 2 loops connected by a straight segment in between the two. It may be made of any semi-flexible or flexible material suited to use in the subject device. For example, it may be made from webbing material. The webbing material may be formed as a flat strap, as shown in FIGS. 1-2, or a cord, as shown in FIG. 3, or any other suitable configuration. The length and width of the webbing and the loops are variable, depending on the particular application for which it is to be used. The device may be constructed of one continuous length of material, or multiple segments bound together. The use of this device offers the unique benefit of allowing the user to pull a stake from the earth at any convenient angle. This benefit is made possible by the flexible material from which the device is constructed.

A padding material 114 may surround at least a portion of the elongated intermediate portion 110 for the comfort of the user and to provide for a better gripping surface. It may be made of, for example, a resilient, stretchable leather and/or sheepskin material, either natural or synthetic. The length and width of the padding material 114 will depend on the length and width of the webbing. The use of the padding material 114 may offer the unique benefit of allowing the user an increase in grip leverage in order to pull a stake from the earth. The use of the padding material 114 may also provide protection and/or reduce the risk of injury to a user's hand.

In use, the lower loop of the device is placed underneath a portion of the stake securing the item being staked to the ground. Depending on the type of stake, this portion can be: the curved portion of the top of a stake (such as in a metal stake), the off-shoot segment extending from the top of a stake (such as in a plastic stake), the head of a stake (such as in a railroad spike or longer spike with similar head), any other portion of a stake where secured attachment can be made. The user places a hand through the upper loop and grasps the middle segment. The top of the upper loop should be on the top side of the user's forearm, while the portion of the upper loop closest to the straight middle segment should be under the user's wrist. With the lower loop secured to the stake to be pulled, the user grasps the middle segment and pulls the stake from the ground.

Uses for the secured stake remover include, but are not limited to: individual or family camping tents, commercial rental/party/wedding tents, awnings or car ports as attached to a recreational vehicle or home, shade tents/canopies/sun shelters, screen houses/gazebos, beach tents, umbrellas, chairs, swing sets/jungle gyms, trampolines, sports nets such as volleyball or badminton, inflatable recreation items such as toy jumpers or slides, inflatable projection screens, inflatable holiday decorations, inflatable yard decorations (sports teams, etc.), inflatable promotional or advertisement units (such as giant tire in front of tire dealer), vendor tents/booths/stands, items requiring stabilizing lines, and similar devices, and combinations thereof.

The secured stake remover could have multiple designs or features, depending on variability in sales channels, targeted users, and differentiation requirements from customers, evolvement of the device, applications of use, or other variables. These variations could include: use of different colors of materials, use of multiple colors of materials, adding padding to various portions of the device, replacing any or all of the webbing material with round rope-like materials, metal or other material cable, metal or other material chain, leather or synthetic leather material instead of flat webbing, using ribbon, a combination of multiple materials, and may further include incorporating an adjustable wrist strap into the device, incorporating an adjustable lower loop into the device, elimination of the wrist loop, addition of a handle in place of a wrist loop, inclusion of multiple lower loops of various sizes for multiple applications, inclusion of a swivel on either loop or both loops to allow free twisting/spinning of the loop(s), interchangeable loop mechanism to allow a user to change sizes of loops for different applications, much like changing the socket size on a driver, attachment for removing closed-end stakes, similar to a carabineer or other spring devices, such as the end of a dog leash, and combinations thereof.

The invention has been described with reference to the preferred embodiments. Obviously, modifications and alterations will occur to others upon reading and understanding the preceding detailed description. It is intended that the invention be construed as including all such modifications and alterations.

The invention claimed is:

1. A stake and a removal device comprising:

a stake secured to a surface at an angle of from 45° to 90°; and a removal device having:

a proximal end in the shape of a first loop and configured to secure an exposed portion of the stake;

a distal end in the shape of a second loop that is configured to receive a user's hand through the second loop such that the second loop is in contact with the top side of the user's forearm; and an elongated intermediate portion in connection with the proximal and distal ends, at least a section of which is configured as a grip for the user's hand, and providing for the proximal end and the distal end to be spaced from one another by the length of the intermediate portion, such that in use the device extends from the stake at an angle of 45° to 90° relative to the surface in which the stake is secured.

2. The stake removal device of claim 1, wherein the device comprises at least one of a natural material, a synthetic material, and combinations thereof.

3. The stake removal device of claim 1, wherein the proximal end, the distal end, and intermediate portion are formed from one continuous length of material.

4. The stake removal device of claim 1, wherein the proximal end, the distal end, and intermediate portion are multiple segments bound together.

5. The stake removal device of claim 1, the distal end loop comprising a strap adjustable buckle.

6. The stake removal device of claim 1, further comprising a padding material surrounding at least a portion of the elongated intermediate portion.

7. The stake removal device of claim 6, wherein the padding material comprises at least one of a natural material, a synthetic material, and combinations thereof.

8. A method for removal of a stake secured to a surface comprising:

providing a stake removal device consisting of a proximal end and a distal end connected by an elongated intermediate portion;

securing the proximal end of the stake removal device to the stake;

a user grasping the distal end of the stake removal device in the user's hand; and the user applying a pulling force to the distal end of the stake removal device and removing the stake from the surface, wherein the angle of the stake removal device when the pulling force is being applied is between about 45° and 90° relative to the surface in which the stake is secured.

9. The method of claim 8, wherein the proximal and distal ends have the shape of a loop.

10. The method of claim 8, wherein the stake removal device comprises at least one of a natural material, a synthetic material, and combinations thereof and at least a portion of the device is flexible.

11. The method of claim 8, wherein the proximal end, the distal end, and intermediate portion are formed from one continuous length of material.

12. The method of claim 8, wherein the proximal end, the distal end, and intermediate portion are multiple segments bound together.

13. The method of claim 8, wherein the distal end comprises a strap adjustable buckle.

14. The method of claim 8, wherein the padding material comprises at least one of a natural material, a synthetic material, and combinations thereof.

* * * * *